United States Patent [19]

Jennison et al.

[11] 4,033,510

[45] July 5, 1977

[54] ARC-TRAVERSING WATER SPRINKLER

[75] Inventors: James M. Jennison, Anaheim; Henry Thomas Williams, Corona del Mar, both of Calif.

[73] Assignee: Thompson Manufacturing Company, Los Angeles, Calif.

[22] Filed: Aug. 26, 1975

[21] Appl. No.: 607,891

[52] U.S. Cl. ..... 239/230; 239/261

[51] Int. Cl.[2] ..... B05B 3/14

[58] Field of Search ..... 239/230, 231, 233, 261; 308/38

[56] References Cited

UNITED STATES PATENTS

| | | | |
|---|---|---|---|
| 1,997,901 | 4/1935 | Englehart | 239/230 |
| 2,714,038 | 7/1955 | Fox et al. | 239/233 |
| 2,792,256 | 5/1957 | Sinex | 239/233 |
| 3,043,522 | 7/1962 | Ryerson | 239/230 |
| 3,080,123 | 3/1963 | Erns | 239/230 |
| 3,204,873 | 9/1965 | Senninger | 239/230 |

*Primary Examiner*—Evon C. Blunk
*Assistant Examiner*—Michael Mar
*Attorney, Agent, or Firm*—Jackson & Jones Law Corporation

[57] ABSTRACT

An oscillating sprinkler wherein a body structure carries a discharge nozzle and an oscillating mechanism which effects turning of the body structure in small increments. A control mechanism reverses the direction of movement of the body structure causing the body structure to move back and forth through a preselected arc. The body structure fixedly supports a metal pin on which the oscillating mechanism is journelled. The oscillating mechanism fixedly supports a metal pin in axial alignment with the metal pin on the body structure and the oscillating mechanism pivots on the end of the pin journelled into it with one end of the pin carried by the oscillating mechanism acting as a bearing surface.

The pin carrried by the oscillating mechanism is journelled in a support plate that fastens to the body structure. One end of a spring member is attached to the portion of the oscillating mechanism pin that extends through the support plate. The other end of the spring member is moveably attached to the support plate allowing the spring force applied to the oscillating mechanism pin to be easily adjusted, as required, according to the prevailing water pressure. The spring member is shielded from the elements in a protective housing.

9 Claims, 2 Drawing Figures

ARC-TRAVERSING WATER SPRINKLER

BACKGROUND OF THE INVENTION

The present invention relates generally to improvements in water sprinklers and more particularly pertains to new and improved arc-traversing water sprinklers wherein a body structure carrying a discharge nozzle moves back and forth through a preselected arc.

Those concerned with the development of the arc-traversing water sprinkler of the type commonly known as "rain-bird" have long experienced the problems of the oscillating member of the sprinkler becoming fouled on its bearing shaft. Also, when such sprinklers are used on lines having high water pressure, they operate eradically in that the oscillating member is caused to bang the body structure twice during one cycle creating opposing revolutionary forces in the body structure. Besides these inadequacies, the prior art sprinklers are not easily repairable. For example, if the oscillating mechanism becomes damaged, the whole unit would have to be replaced.

OBJECTS AND SUMMARY OF THE INVENTION

An object of this invention is to provide an oscillating sprinkler that is easily adapted to different water-line pressures.

Another object of this invention is to provide an oscillating sprinkler that is relatively immune to foreign particles clogging the operation of the oscillating mechanism.

Yet another object of this invention is to provide an oscillating sprinkler that provides ease of disassembly for the purpose of cleaning the oscillating mechanism pivot points and for repair.

A further object is to provide an oscillating sprinkler that provides a long-wearing and relatively friction-free pivot for the oscillating mechanism.

Yet another object is to provide an oscillating sprinkler that maintains its oscillating spring member in a housing that protects the spring from damage.

These objects and the general purpose of this invention are accomplished in the following manner. The body structure of the sprinkler which moves through a predetermined arc carries a pin which has its extending end formed to provide a pivot surface. The oscillating mechanism has a bearing aperture therein slightly larger in diameter than the diameter of the body structure pin. One opening of the bearing aperture receives a pin that is fixedly inserted into it. The end of this oscillating mechanism pin in the bearing aperture acts as the bearing surface for the body structure pin pivot surface.

A support plate carried by the body structure has a bearing aperture therein to receive the oscillating mechanism pin. This support plate carries a spring mechanism which is attached to the end of the oscillating mechanism pin protruding beyond the support plate, in addition to the support plate. The attachment of the spring mechanism to the support plate is adjustable in a manner that provides a variable rotational force on the oscillating mechanism pin. The spring mechanism is shielded from the elements by a protective housing.

BRIEF DESCRIPTION OF THE DRAWINGS

Other objects and many of the attendant advantages of this invention will become readily appreciated as the same becomes better understood by reference to the following detailed description when considered in conjunction with the accompanying drawings in which like referenced numerals designate like parts throughout the figures thereof and wherein.

DESCRIPTION OF THE PREFERRED EMBODIMENTS

Figure 1:
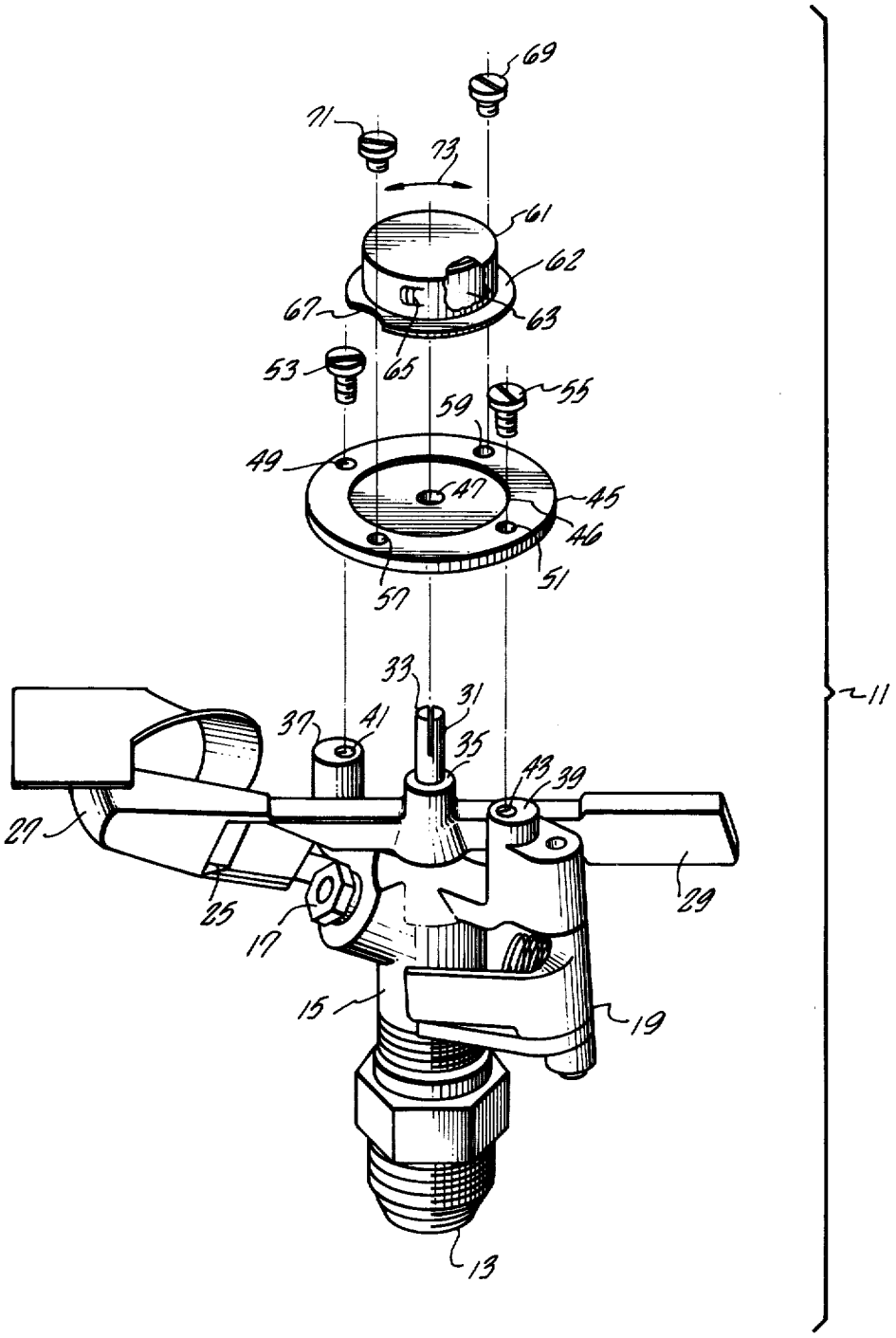
FIG. 1 is an exploded perspective, with sections thereof partially broken away, of the preferred embodiment of the present invention.

The improved arc-traversing water sprinkler of the present invention is shown in FIG. 1 in a partially disassembled perspective. The sprinkler is preferably an oscillating type having a body structure 15 which carries a nozzle 17. The body structure 15 is attached to a water line by way of threaded joint 13. A control mechanism 19, well known in the art, is attached to the body structure and causes the body structure 15 to reverse its arcuate movement, thereby causing the body structure 15 to move back and forth along a preselected arc.

The movement of the body structure is caused by the oscillating mechanism 29 which oscillates back and forth across the jet stream coming from the nozzle 17. The force of the jet stream emitted from the nozzle 17, striking the spoon end 27 of the oscillating mechanism 29, through the orifice 25, deflects that mechanism in a counter-clockwise direction. The oscillating mechanism 29 is brought back to the "home" position, shown in FIG. 1 by a spring mechanism of a type that will be more fully described hereinafter.

Figure 2:
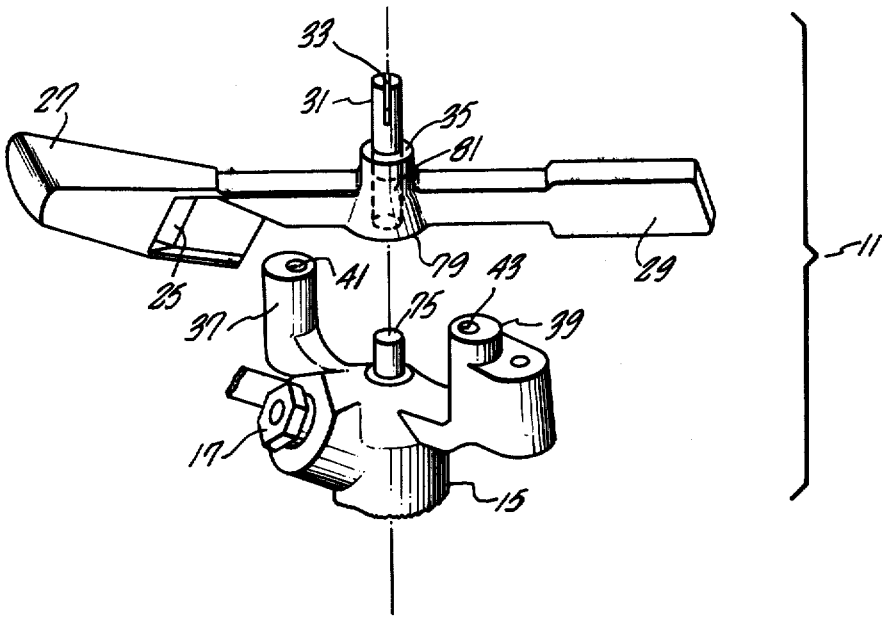
FIG. 2 is an exploded perspective illustrating the relationship between the body structure part and the oscillating mechanism part of the present invention.

Refer now to FIG. 2 for an illustration of the supporting and pivotal relationship between the body structure 15 of the sprinkler and the oscillating mechanism 29. The body structure 15 has a pin 75 fixedly attached at a top position 77 of the body structure. This pin 75 is in axial alignment with a pin 31 fixedly attached to a boss 35 on the oscillating mechanism 29. The tip of the pin 75 is preferably formed into a convex surface or any other convenient pivot bearing type surface. The pin 31, fixedly attached to the oscillating mechanism 29 extends into the oscillating mechanism 29 through boss 35 for a preferred distance 81, thereby forming a closed-end journal bearing aperture 79 in the oscillating mechanism 29. The pin 75 is received by this closed-end journal bearing aperture 79. The tip of the pin 75 and the end of the pin 31 inside the oscillating mechanism 29 form an arcuate pivot bearing for the oscillating mechanism 29. The pin 75 on the body structure 15 and pin 31 on the oscillating mechanism 29 are preferably made of a metal such as high nickel steel, thereby providing a long lasting and relatively friction free pivot bearing. The pin 31 on the oscillating mechanism 29 is slotted 33 for a purpose that will be explained hereinafter.

Referring again to FIG. 1, the body structure 15 has a pair of boss members 37 and 39 which contain threaded holes 41 and 43 respectively therein. These boss members support a support plate 45 which has a bearing aperture 47 therethrough in axial alignment with the pin 31 of the oscillating member 29. With support member 45 in place, bolts 53 and 55 pass through apertures 49 and 51, respectively into the threaded holes 41 and 43 respectively to hold support member 45 tightly to the body structure 15. In this position, the support plate 45 provides a journal bearing for pin 31. The upper end of pin 31 which has a slot 33 cut therein extends through the bearing aperture 47 of the support plate 45.

The support plate 45 has a counter-sunk circular surface section 46 for receiving the brim 62 of torsional spring housing 61.

A pair of threaded holes 57 and 59 are provided at the circumference of the counter-sunk surface section 46 to receive a pair of bolts 71 and 69 respectively. These bolts are located at the circumference of the recessed section 46 so that their heads overhand the brim 62 of the torsional spring housing 61. The brim 62 has a pair of recesses 67 (only one being shown) which allow the spring housing 61 to be placed in the countersunk surface section 46 of the support plate 45 without removing the bolts 71 and 69 therefrom.

The spring housing 61 contains a helical wound torsional spring 63 preferably made up of flat spring material such as spring stainless steel, for example. One end of this helical spring is fastened to a point 65 on the side of the spring housing 61. This is the outside end of the helical wound spring. The inside end of the helical wound spring is bent at an acute angle to form a blade (not shown) for insertion into the slot 33 of pin 31. The spring housing 61 protects the spring 63 contained therein from the elements and inadvertant impact force.

With the blade of the spring 63 inserted into slot 33, and the bolts 71 and 69 loosened to permit the housing 61 to rotate in a clockwise or counter-clockwise direction 73, the torsional spring force applied to the pin 31, and consequently to the oscillating mechanism 29, can be easily adjusted by rotating the spring housing 61 either in a clockwise or counterclockwise direction. If an increased returning force is desired on the oscillating mechanism 29, the spring housing 61 is rotated in a clockwise direction. If a decreased returning force is desired, the spring housing 61 is rotated in a counterclockwise direction.

When the oscillating sprinkler of the present invention is connected to a water line that has extremely high pressure and utilizes a nozzle 17 that permits a large water jet to issue therefrom, the force exerted by this water jet on the oscillating mechanism 29 of the sprinkler, may cause the oscillating arm to swing too far in a counter-clockwise direction. This swing may exceed a 90° arc from its rest position, causing the oscillating mechanism to bang against the body structure in a counter-clockwise direction. This causes the body structure to be rotated in a counter-clockwise direction. This direction of movement of the body structure is undesireable when the control mechanism 19 is actuated to provide clockwise rotation of the body structure. In order to prevent this counter-productive force being applied to the body structure, the bolts 71 and 69 that are threaded into the support plate 45 are loosened and the spring housing 61 is rotated in a clockwise direction, causing the torsional spring tension on the pin 31 to be increased. This tension is increased until the force of the water jet issuing from the nozzle 17 is no longer strong enough to overcome the spring tension and deflect the oscillating mechanism 29 through an arc large enough to cause a counter-clockwise force on the body structure 15.

If the same sprinkler is used on a water line having a lower water pressure, the torsional spring force applied to pin 33 and consequently, the force maintaining the oscillating mechanism 29 at its home position as shown in FIG. 1, may be too great for the water pressure on that particular line. In such an instance, the torsional spring force may be reduced by loosening the bolts 71 and 69 and rotating the spring housing 61 in a counterclockwise direction to a position where the oscillating mechanism 29 traverses an arc having the desired number of degrees. An arc of approximately 45 to 80 degrees is preferred.

If the oscillating mechanism 29, because of structural fatigue or vandalism or some other cause, is broken, the sprinkler will no longer function appropriately in that the body structure will no longer rotate through its preselected arc. In such an instance, a new oscillating mechanism may be easily substituted for the broken one by simply loosening and removing the bolts 53 and 55 that hold the support plate 45 to the body structure bosses 37 and 39. With the support plate 45 removed, the broken oscillating mechanism 29 may be easily slipped off the pin 75 (FIG. 2) and a new oscillating mechanism 29 slipped on. The support plate 45 and the spring mechanism 61–63 may be easily reassembled thereafter to again provide a working sprinkler. The spring mechanism 61–63 may also be replaced with similar ease.

In very dusty or sandy areas, prior art sprinklers of the type illustrated have experienced the problem of sand or dust collecting in the pivot bearing of the oscillating mechanism to an extent where the oscillating mechanism becomes jammed and is no longer moved by the jet of water issuing from the nozzle 17. The bearing and support mechanism of the present invention alleviates this problem to a great extent by the use of the pin 75. Besides supporting the oscillating mechanism 29, it additionally provides a pivoting bearing surface that is internal to the oscillating mechanism 29, and therefore, isolated from dust and dirt particles. However, in the instance where conditions are extreme and the oscillating mechanism does jam, it is a simple matter to disassemble the supporting plate 45, remove the oscillating mechanism 29, clean off the bearing pin 75 on the body structure and reassemble these parts.

What has been described in an oscillating sprinkler that is easily adapted to work with optimum efficiency on a wide range of water pressures. In addition, the oscillating sprinkler of the present invention is, to a great extent, immune from foreign particles impeding the operation of its oscillating mechanism. In the instance when the oscillating mechanism is jammed because of foreign matter becoming lodged therein, or because it has been broken, it is a simple matter to disassemble the sprinkler and replace the oscillating mechanism. The only tool required is a screwdriver. The spring mechanism for the oscillating mechanism is contained within a housing that protects it from external impact and the elements.

Obviously, many modifications and variations of the present invention are possible in light of the above teachings. It is therefore to be understood that within the scope of the appended claims, the invention may be practiced otherwise than as specifically described.

What is claimed is:

1. In an oscillating sprinkler including a body structure having a discharge nozzle, and an oscillating mechanism actuated by the water jet issuing from said nozzle to effect turning of said body structure, the improvement therein comprising:

first a pin fixedly located on said body structure;

a closed-end journal bearing on said oscillating mechanism for receiving said first pin, said oscillating mechanism being supported by and pivoting on said first pin a second pin fixedly located on said oscillating mechanism; and a spring mechanism attached to said second pin and said body structure.

2. The improved oscillating sprinkler of claim 1 wherein said first pin has its exposed end shaped into a pivot bearing surface.

3. The improved oscillating sprinkler of claim 1, wherein:

said second pin is fixedly located on said oscillating mechanism is axial alignment with said closed-end journal bearing; and further comprising a supporting plate removably fastened to said body structure having an aperture for receiving said second pin.

4. The improved oscillating sprinkler of claim 3 wherein said body structure has a plurality of threaded apertures therein in axial alignment with apertures in said support plate, whereby the support plate is fastened to said body structure by bolts passing through said support plate into said body structure.

5. The improved oscillating sprinkler of claim 3, wherein said spring mechanism comprises:

a torsional spring attached to the end of said second pin protruding through said support plate.

6. The improved oscillating sprinkler of claim 3, wherein said spring mechanism comprises:

a torsional spring fixedly attached to the end of said second pin protruding through said support plate and adjustably attached to said support plate, whereby the torsional force applied to said oscillating mechanism pin by said torsional spring mechanism is manually adjustable.

7. The improved oscillating sprinkler of claim 5, wherein said spring mechanism includes a housing covering said torsional spring, said housing being attached to said torsional spring and said support plate.

8. In an oscillating sprinkler including a body structure having a discharge nozzle, and an oscillating mechanism actuated by the water jet issuing from said nozzle to effect turning of said body structure, the improvement therein comprising:

a first pin fixedly located on said body structure;

a bearing on said oscillating mechanism for receiving said first pin;

a second pin fixedly located on said oscillating mechanism; and a support plate fastened to said body structure and engaging said second pin on said oscillating mechanism.

9. The improved oscillating sprinkler of claim 8 wherein said body structure has a plurality of threaded apertures therein in axial alignment with apertures in said support plate, whereby said support plate is fastened to said body structure by bolts passing through said support plates into said body structure.

* * * * *